United States Patent [19]

Van Wersch et al.

[11] 4,349,930

[45] Sep. 21, 1982

[54] CONTINUOUS METHOD FOR UNIFORM FOAM TREATMENT OF PLANAR TEXTILE STRUCTURES

[75] Inventors: Kurt Van Wersch, Wegberg; Manfred Pabst, Cologne, both of Fed. Rep. of Germany

[73] Assignee: A. Montforts, Monchen-Gladbach, Fed. Rep. of Germany

[21] Appl. No.: 192,230

[22] Filed: Sep. 30, 1980

[30] Foreign Application Priority Data

Oct. 1, 1979 [DE] Fed. Rep. of Germany ..... 2939767

[51] Int. Cl.[3] ..... D06B 5/08

[52] U.S. Cl. ..... 8/151; 68/204

[58] Field of Search ..... 8/149.1, 151, 477; 68/DIG. 5, 8, 20, 204, 205 R; 427/350, 373; 118/50, 257

[56] References Cited

U.S. PATENT DOCUMENTS

| | | | |
|---|---|---|---|
| 2,354,033 | 7/1944 | McGladrey et al. | 427/350 |
| 3,042,573 | 7/1962 | Roberts | 8/477 X |

FOREIGN PATENT DOCUMENTS

| | | | |
|---|---|---|---|
| 39-3322 | 3/1964 | Japan | 68/204 |
| 1400146 | 7/1975 | United Kingdom | 118/257 |

*Primary Examiner*—Philip R. Coe

*Attorney, Agent, or Firm*—Herbert L. Lerner; Laurence A. Greenberg

[57] ABSTRACT

Continuous method for uniform foam treatment of planar textile structures wherein a foamed treatment medium for finishing and/or dyeing is applied to the planar structure which is then subjected to underpressure, which includes sucking the foam onto the planar structure to which the foam is to be applied, and introducing the foam together with the planar structure into an underpressure chamber wherein the pressure is low compared to the internal pressure of the bubbles of the foam.

4 Claims, 2 Drawing Figures

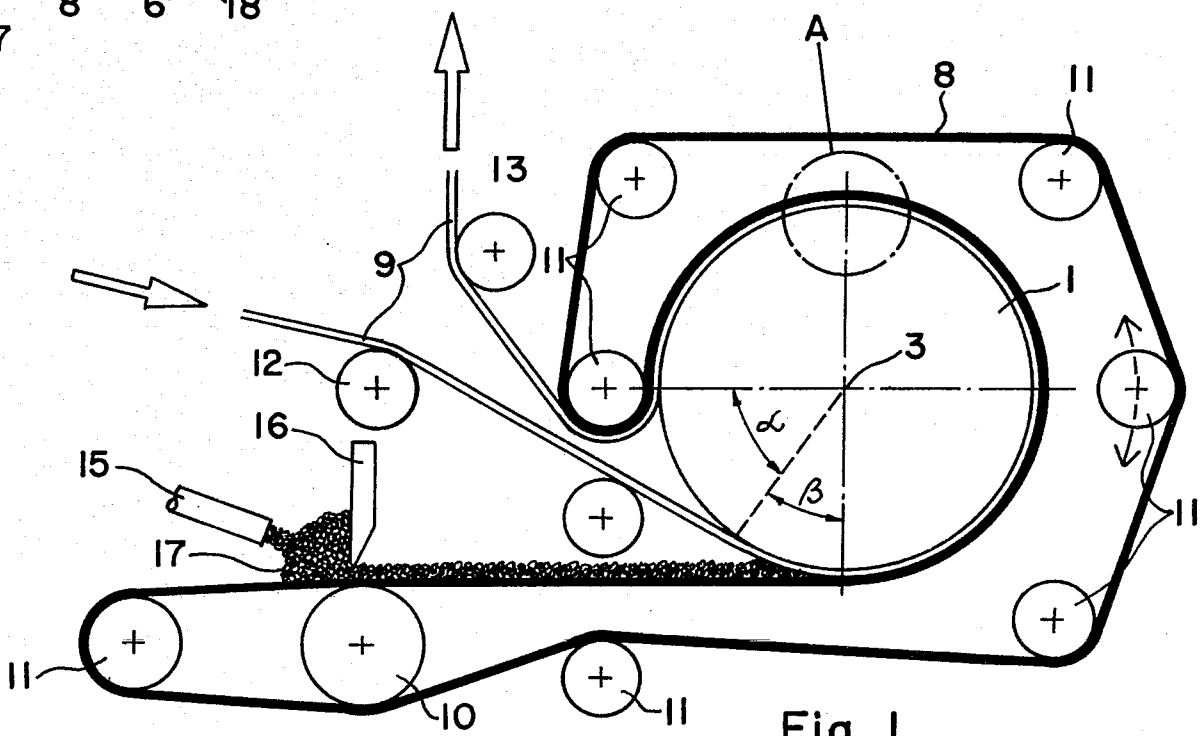
Fig. 1
Fig. 2
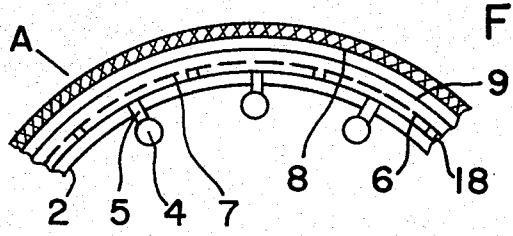

CONTINUOUS METHOD FOR UNIFORM FOAM TREATMENT OF PLANAR TEXTILE STRUCTURES

The invention relates to a continuous method for uniform foam treatment of planar textile structures, wherein a foamed treatment medium or liquor provided for finishing and/or dyeing is applied to the planar structure and the latter is then subjected to underpressure. Depending upon the treatment medium, the application and subsequent destruction of the foam can be followed by fixation of the treatment medium on the textile material. Finishing agents of all kinds, such as dye stuffs, natural and synthetic resins, and the like can be considered as treatment media, to the extent that these materials, especially in aqueous solution, can be foamed at all.

In applying a treatment medium to a web of textile material, for example of wiping-on, one seeks to keep the amount of treatment liquor as small as possible relative to the weight of the planar structure and, thereby, to keep the concentration of the treatment liquor in the treatment medium as great as possible. By such minimizing of the application, through which, of course, the quality of the treatment and, especially, the uniform distribution of the treatment medium in the web of material must not suffer, an objective is sought after, among other things, that individual processing steps such as driving out an excess of treatment material especially by squeezing, be eliminated, and drying costs as well as waste water costs, if applicable, be lowered.

One method for minimizing the application of treatment medium is described in German Published Prosecuted Application (DE-AS) No. 22 14 377, wherein the treatment medium is first foamed by means of a gaseous propellant, and the foam is then applied to the textile material in the form of a layer. Disintegration or decay of the foam is then effected and, subsequent thereto, the substances applied with the foam are fixed on the textile material. The decay or disintegration is supposed to be brought about, without any suction of the foam into the textile material, by foam destroying means, or due to the composition of the foam itself. This decay or disintegration of foam, brought about, in essence, by chemical means, does not occur instantaneously, however, but only within a given minimum time and then only with a given half-life period i.e. not completely.

The problems associated with the destruction of the foam can be eliminated in the method of the type mentioned in the introduction hereto and with minimum application by the provision that the foam, which generally consists of bubbles with a diameter of about 0.001 to 0.1 mm, is destroyed completely in the underpressure or negative pressure treatment without appreciable flow-through, due to a suitable choice of the intensity of the underpressure i.e. the foam-coated planar structure is passed, preferably covered air-tightly on one side, through an underpressure space, the underpressure of which (for example 0.01 bar to 0.1 bar absolute) is low when compared to the internal pressure (about 1 bar) of the foam bubbles.

This procedure can be effected by air-tightly covering the planar structure on the surface coated with the foamed treatment medium (on one side) by means of a flexible cover layer and, on the opposite surface of the planar structure which is in contact with an air-permeable support layer, subjecting the planar structure to the underpressure which, in essence, acts upon the foam bubbles like a vacuum. The air-permeable support layer may be, for example, a cylinder shell connected on the inside to a vacuum space. Especially in this case, the air-permeable, flexible cover layer may be a preferably endless follower, such as a backing cloth, which revolves around a cylinder, making contact with the cylinder shell. For carrying out the method according to the invention, apparatus can be used which is, in principle, like that described in German Published Prosecuted Application (DE-AS) No. 25 02 149, but wherein a cover layer with fine capillaries on the supporting wire screen surrounding the drum is to be dispensed with, however.

When using such or another type of supporting or impressing of the web of material between an air-impermeable cover layer and an air-permeable support layer that can be connected to a vacuum, the problem arises of preventing foam, which may have been wiped-on in accordance with German Published Non-Prosecuted Application (DE-OS) No. 27 15 862, from backing up or damming where the planar structure meets or runs together with the air-impermeable cover layer. Regardless of whether the foam is transfered for example, in the apparatus with the drum which is evacuated from the inside and is covered on the outside at least partially by an air-impenetrable backing cloth follower, directly to the web of material to be treated, or is first transfered to the backing cloth follower and, after the backing cloth follower and the web of material run together, is then transfered at the respective inlet gap to the web of material, the uniformity of the foam distribution can suffer when the foam enters the inlet gap formed at the periphery of the drum between the backing cloth follower and the web of material.

It is an object of the invention to provide a method of the type mentioned at the introduction hereto, which ensures uniformity of the foam application, originally achieved, for example, by wiping-on, the uniformity being maintained until the foam bubbles decay or disintegrate.

With the foregoing and other objects in view, there is provided, in accordance with the invention, a continuous method for uniform foam treatment of planar textile structures wherein a foamed treatment medium for finishing and/or dyeing is applied to the planar structure, which is then subjected to underpressure, which comprises sucking the foam onto the planar structure to which the foam is to be applied, and introducing the foam together with the planar structure into an underpressure chamber wherein the pressure is low compared to the internal pressure of the bubbles of the foam. As shown hereinafter, the underpressure chamber is preferably formed as a squeeze gap which extends areally partially around the periphery of a cylindrical drum.

When employing apparatus similar to that according to German Published Prosecuted Application (DE-AS) No. 25 02 149 but without the cover layer of fine capillaries on the wire supporting wire screen surrounding the drum, the method according to the invention comprises applying the foam directly to the planar structure or to an air-impermeable back cloth which can be brought into contact with the planar structure synchronously and over an area at an inlet gap leading to the underpressure chamber gap and, prior to the destruction of the foam resulting from the underpressure, which is small compared to the internal pressure of the bubbles of the foam, exerting a suction force onto the foam from the planar structure beforehand ahead of the inlet gap leading to the underpressure space.

In the last analysis, something is done in accordance with the invention for achieving the aforestated desired effect, which is supposed to be avoided or prevented in a machine known from German Published Prosecuted Application (DE-AS) No. 25 02 149 for the purpose of saving energy, namely, connecting the parts of the drum periphery not covered by the backing cloth follower to the vacuum pump. By the suction force acting, according to the invention, in direction toward the planar structure to be foamed and being relatively small, the foam is pressed against the planar structure or is held by the web of material, however, so that the foam can be drawn into the gap between the web of material and the backing cloth follower without difficulty and, above all, as uniformly as it had been applied.

What is achieved by the invention is that, regardless of whether the foam was already on the web of material or still on the backing cloth follower when entering the gap or the space, respectively, between the backing cloth follower and the planar structure, a suction or flow, respectively, in direction toward the planar structure is exerted and, thereby, any beginning of a foam back-up is suppressed immediately. It is therefore possible through the invention to direct a foam layer completely uniformly into the squeeze gap which extends over part of the periphery of a drum evacuated from the inside.

A further mode of the method according to the invention calls for the use of an air-impermeable backing cloth follower which is passed over a drum having at the surface thereof a support layer acted upon by underpressure, and comprises running the planar structure, which is to be passed between the support layer and the planar follower onto the support layer beforehand considerably ahead of the backing cloth follower and exerting underpressure or suction force in direction toward the backing cloth follower and the foam disposed thereon, respectively, from a peripheral section of the drum shell disposed ahead of a run-up line of the backing cloth follower.

Whereas, in a drum of the aforedescribed type, efforts have been made, heretofore, normally not to permit the underpressure coming from the inside to act upon the sector of the cylinder periphery not covered by the air-permeable backing cloth follower, in order to minimize the load on the corresponding vacuum pump, at least one part of this sector is connected, according to the invention, to the corresponding vacuum pump in order to prevent development of a back-up of the foam ahead of the inlet gap. The operability of the apparatus according to the invention is thus ensured according to the invention only by tolerating an apparent disadvantage. It should be noted, however, that the foam should not be sucked to any great extent into the volume of the respective web of material in the region ahead of the inlet gap; it is rather enough if the foam is merely held fast sufficiently for the introduction thereof into the following underpressure space or chamber. Therefore, only a respectively small underpressure or suction force, which does not cause appreciable flow-through i.e. suction of the foam into the web of material, is necessary in the region ahead of the inlet gap. Power-consuming air movement, such as takes place for example, in the device known from German Published Non-Prosecuted Application (DE-OS) No. 24 02 342 in connection with the foaming, is therefore not needed in the method according to the invention. The introduction of the foam into the volume of the web of material, and particularly also the destruction of the foam bubbles, takes place, according to the invention and contrary to the aforementioned heretofore known state of the art, only in the succeeding underpressure space or chamber and practically without flow-through i.e. with considerably less power consumption than heretofore. In the underpressure treatment with airtight covering of the web of material on one side, the foam is destroyed practically instantaneously and, simultaneously with the destruction of the foam, the individual elements or fibers, respectively, of the web of material, down to a predetermined spatial depth within the thickness of the web of material, are wetted by the foam bubbles which burst due to the underpressure.

Other features which are considered as characteristic for the invention are set forth in the appended claims.

Although the invention is illustrated and described herein as embodied in a continuous method for uniform foam treatment of planar textile structures, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIG. 1 is a diagrammatic elevational view of an apparatus for carrying out the method of continuously finishing and/or dyeing planar textile structures in accordance with the invention; and FIG. 2 is an enlarged fragmentary sectional view of FIG. 1 showing the region A thereof.

Referring now to the drawing, there is shown in FIGS. 1 and 2, an embodiment of the apparatus for carrying out the method according to the invention, which includes a cylinder shell or casing 1 with a multiplicity of holes 5 which can be connected at the inner side 2 of the cylinder to an underpressure or negative pressure chamber or space or a non-illustrated vacuum pump by means of lines 4, which extend for example, parallel to the cylinder axis 3 for generating an underpressure, a support layer 7 which evenly or uniformly distributes or equalizes the underpressure on the drum surface 6; and an air-impermeable endless follower or backing cloth 8 which can be pressed against the cylinder surface 6 or support layer 7, respectively, by the underpressure, with an inlet section, wherein the planar textile structure 9 to be treated can be conducted at the cylinder surface 6 between the backing cloth follower 8 and the support layer 7. The backing cloth follower 8 runs over rolls 10 and 11 on the one side, and the surface 6 of the cylinder shell 1 on the other side. It is advantageous, for feeding the underpressure to the surface of the cylinder shell 1 to the non-illustrated vacuum pump to connect only those lines 4 which are provided for acting on the area of the cylinder surface 6 covered by the backing cloth follower 8, i.e. when the cylinder shell 1 revolves. According to FIG. 1, the sector of the cylinder shell periphery encompassed within the angles $\alpha+\beta$, would not be subjected to the underpressure, acccording to this regulation i.e., the lines 4 belonging to this sector of the cylinder periphery would have to be decoupled from the connection to the underpressure space or chamber or the vacuum pump by means of a revolving control head.

According to the illustrated embodiment, the planar textile structure 9 to be treated is introduced over a roller 12 between the support layer 7 on the cylinder surface 6 and the backing cloth follower 8 as well as drawn over one of the rollers 11 and the roller 13 out of the apparatus for carrying out the method according to the invention, for example, to a plaiting-down device.

It may be advantageous not to apply the foam provided for treating the planar structure 9, which may be a dyeing agent as well as some other treatment medium, directly to the planar structure 9 but first, preferably in the vicinity of a roller 10, to the backing cloth follower 8. The foam can be applied to the backing cloth follower 8, for example, by means of a slit nozzle 15 extending parallel to the axis of the roller 10. For equalizing or uniformly distributing the foam, a wiper or doctor 16 is then suited.

From the point of application at the wiper 16, the foam 17 travels together with the backing cloth follower 8 to the inlet gap, where the backing cloth follower 8 meets or runs together with the planar structure 9 at the surface 6 of the cylinder shell 1, and is to be transfered to the planar structure 9, respectively, during or after the running-together. Depending upon the choice of the thickness of the applied layer of foam 17, uniform dyeing of the goods to be treated, either complete of encompassing part of the layer thickness of the planar structure 9, can be achieved in the manner described hereinabove. The penetration of the foam 17 into the planar structure 9 is accomplished in essence, by the fact that the foam 17 is brought, together with the planar structure 9, into a vacuum having residual pressure which is so low that virtually instantaneous, complete disintegration or destruction of all the foam bubbles is ensured, which is in any event complete by the time the planar structure 9 is running-off from the surface of the backing cloth follower 8. Because of the underpressure, foam bubbles which have substantially normal pressure inside, first expand greatly before they burst; however, they have no freedom of motion in the direction toward the impermeable backing cloth follower 8 but only in the direction toward the interior of the planar structure 9 and they therefore wet the latter accordingly with a depth corresponding to the thickness of the foam layer which is applied.

Regardless of whether the foam is applied immediately onto the planar structure 9, or first onto the backing cloth follower 8, there is danger, in the region immediately ahead of the inlet gap where the backing cloth follower 8 meets the planar structure 9, of the foam backing up or damming so that the application of the foam cannot always be controlled without difficulty. According to the invention, the underpressure acting from the interior of the cylinder is therefore switched beforehand to a sector of the periphery of the cylinder shell 1 encompassed by the angle $\beta$ in FIG. 1 and not covered up by the backing cloth follower 8, before the backing cloth follower 8 and the planar structure 9 meet, so that the foam, which is to be applied or brought to the planar structure 9 or already lies on the latter, is attracted or drawn to the textile material already in this inlet region. Thereby, damming or backing-up of the foam ahead of the inlet gap can be avoided.

The support layer 7 which is advantageously arranged directly on the surface 6 of the cylinder shell 1 has the purpose of achieving uniform distribution of the underpressure directed through the holes 5 to the surface 6 of the cylinder shell 1. This support layer 7 may, for example, be a wire screen fabric, which is connected to the surface 6, for example, by means of strips 18. The strips 18 should extend substantially parallel to the axis 3 of the cylinder shell 1 in order to prevent the development of a suction pull in the peripheral direction of the cylinder.

There are claimed:

1. Continuous method for uniform foam treatment of planar textile structures wherein a foamed treatment medium for finishing and/or dyeing is applied to the planar structure which is then subjected to underpressure, which comprises sucking the foam onto the planar structure to which the foam is to be applied, introducing the foam together with the planar structure into an underpressure chamber wherein the pressure is low compared to the internal pressure of the bubbles of the foam, applying the foam directly to the planar structure and, prior to disintegration of the foam by applying underpressure thereto which is low compared to the internal pressure of the bubbles of the foam, exerting a suction force onto the foam from the planar structure beforehand ahead of an inlet gap leading to the underpressure chamber.

2. Continuous method for uniform foam treatment of planar textile structures wherein a foamed treatment medium for finishing and/or dyeing is applied to the planar structure which is then subjected to underpressure, which comprises sucking the foam onto the planar structure to which the foam is to be applied, introducing the foam together with the planar structure into an underpressure chamber wherein the pressure is low compared to the internal pressure of the bubbles of the foam, applying the foam to an air-impermeable planar follower contactable with the planar structure in synchronizing therewith ahead of an inlet gap leading to the underpressure chamber and, prior to disintegration of the foam by applying underpressure thereto which is low compared to the internal pressure of the bubbles of the foam, exerting a suction force onto the foam from the planar structure beforehand ahead of the inlet gap leading to the underpressure chamber.

3. Method according to claim 1 or 2 wherein the suction force is of such magnitude that transport of the foam into the planar structure and disintegration of the foam remains precluded.

4. Continuous method for uniform foam treatment of planar textile structures wherein a foamed treatment medium for finishing and/or dyeing is applied to the planar structure which is then subjected to underpressure, which comprises sucking the foam onto the planar structure to which the foam is to be applied, introducing the foam together with the planar structure into an underpressure chamber wherein the pressure is low compared to the internal pressure of the bubbles of the foam, passing an air-impermeable planar follower over a drum having, at the surface thereof, a support layer subjected to underpressure, running the planar structure, which is to be passed between the support layer and the planar follower, onto the support layer beforehand considerably ahead of the planar follower, and exerting underpressure from a peripheral section of the drum shell disposed ahead of the run-up line of the planar follower in direction toward the planar follower and the foam disposed thereon, respectively.

* * * * *